US006186397B1

(12) United States Patent
Brouwer

(10) Patent No.: US 6,186,397 B1
(45) Date of Patent: Feb. 13, 2001

(54) METHOD FOR OPERATING A FIRE-CONTROL SYSTEM BASED ON A HEURISTIC ALGORITHM

(75) Inventor: Jan Klaas Brouwer, Diepenheim (NL)

(73) Assignee: Hollandse Signaalapparaten B.V., Hengelo (NL)

( * ) Notice: Under 35 U.S.C. 154(b), the term of this patent shall be extended for 0 days.

(21) Appl. No.: 09/147,705

(22) PCT Filed: Aug. 20, 1997

(86) PCT No.: PCT/EP97/04754

§ 371 Date: Feb. 22, 1999

§ 102(e) Date: Feb. 22, 1999

(87) PCT Pub. No.: WO98/09131

PCT Pub. Date: Mar. 5, 1998

(30) Foreign Application Priority Data

Aug. 26, 1996 (NL) ..... 1003873

(51) Int. Cl.[7] ..... G06F 19/00

(52) U.S. Cl. ..... 235/411; 235/400

(58) Field of Search ..... 235/400, 401, 235/404, 411; 342/64, 52, 53, 62, 63; 244/3.14, 3.15, 3.16, 3.17

(56) References Cited

U.S. PATENT DOCUMENTS 5,341,142 * 8/1994 Reis et al. ..... 342/64

* cited by examiner

*Primary Examiner*—Karl D. Frech
(74) *Attorney, Agent, or Firm*—Oblon, Spivak, McClelland, Maier & Neustadt, P.C.

(57) ABSTRACT

A method of operating a fire-control system for simultaneously engaging a plurality of threats in which one plan from a pool of heuristically determined feasible plans is selected based on an environment of the fire-control system and a selected criterion to engage the plurality of threats. In addition, a genetic algorithm is applied to the pool of feasible plans prior to selecting the one plans to generate additional plan to replenish the pool, and a best feasible plan is selected from the pool with the criterion serving as the standard. Further, at least one randomly selected feasible plan is added to the pool of feasible plans before the genetic algorithm is applied to the pool of feasible plans.

11 Claims, 1 Drawing Sheet

METHOD FOR OPERATING A FIRE-CONTROL SYSTEM BASED ON A HEURISTIC ALGORITHM

BACKGROUND OF THE INVENTION

1. Field of the Invention

A method for operating a fire-control system based on a HEURISTIC ALGORITHM.

The invention relates to a method for operating a fire-control system suitable for at least substantially simultaneously engaging a plurality of threats, employing sensors and weapons, whereby, on the basis of an environment of the fire control system and on the basis of a selected suitability criterion, one planning is selected from a pool of for instance heuristically determined feasible plannings in order to engage the threats.

2. Discussion of the Background

A method of this type is effectively applied in large fire-control systems as for instance installed on board naval craft. It is found, however, that the formulation of heuristically determined plannings, based on a large amount of tactical and logistic information is a time-consuming process. Moreover, a pool of plannings thus determined will never be complete, since experience shows that threats are continuously turning up for which no suitable planning exists. Also a minor change in the fire-control system proves to be disastrous to the existing plannings. In conclusion it has been found that a commander, who has the ultimate decision in the selection of a feasible planning, is faced with the virtually impossible task of selecting a best feasible planning in the short space of time available to him. The fact that the own ship's chance of survival is generally taken as suitability criterion illustrates the importance of finding the best feasible planning.

SUMMARY OF THE INVENTION

The method according to the invention is likewise based on a pool of feasible plannings, but is characterized in that prior to the selection of a planning, a genetic algorithm is applied to the pool of feasible plannings in order to generate additional plannings to replenish the pool and that a best feasible planning is selected from the pool with the suitability criterium, which may depend on the tactical situation, serving as the standard. This allows the generation of plannings which are not entirely determined on a heuristic basis, which may increase the chance of survival of the ship or of an object to be protected.

In the absence of special provisions, genetic algorithms will, besides to feasible plannings, especially generate plannings that are unfeasible, for instance when they do not allow for the limitations of a weapon, a sensor or the available ammunition. A favourable embodiment of the method according to the invention is thereto characterized in that the genetic algorithm generates feasible plannings only. This precludes the pool of feasible plannings from being contaminated with unfeasible ones.

In generating heuristically determined plannings, it is quite possible that certain groups of potentially feasible plannings are left out of consideration, for instance when they are not in accordance with the then current strategies. To this end, it is recommendable to also add several less well-considered, potentially feasible plannings which may cause the subsequent generations of plannings produced by the genetic algorithm to take a slightly unforeseen turn. An advantageous implementation of the method is thereto characterized in that, before applying the genetic algorithm to the pool of feasible plannings, at least one randomly selected feasible planning is added to the pool of feasible plannings.

It is inherent in many types of known genetic algorithms that the successively produced generations may strongly differ from one another. For the application described in this patent specification, this is more or less undersirable. It is advantageous that successive generations of feasible solutions show a certain measure of continuity. A further advantageous embodiment of the method according to the invention is thereto characterized in that the genetic algorithmgenerates successive generations of feasible plannings exclusively under application of crossovers, mutations, permutations and cloning.

A still further enhancement of the continuity can be achieved by applying a method which is characterized by generated crossovers being exclusively of the singular type.

To prevent marginally unfeasible plannings from being removed, a still further implementation of the method is characterized in that, by executing a repair algorithm, continuous efforts are made to convert an unfeasible planning generated by the genetic algorithm into a feasible planning.

In creating successive generations of feasible plannings, it is required to fix a moment on which a feasible planning is selected from the then available pool of feasible plannings. Because on every occasion that a new generation is created, cloning is also applied and, consequently, no near-optimal plannings will be lost, it is likely that the quality of feasible plannings that become available will continuously be improved. A still further advantageous embodiment of the method according to the invention is thereto characterized in that the best feasible planning is selected at a moment that the time available for the selection has at least substantially elapsed.

Because for the ship with the fire control system the effective objective may, per mission, vary, a still further embodiment is characterized in that, depending on the mission, a new suitability criterion can be imposed on the fire-control system. Thus, for instance, the suitability criterion will preclude missiles from being deployed during peacekeeping operations or chaff from being released for own defense purposes when defending a nearby valuable object.

A still further, exceptionally advantageous implementation of the method is characterized in that a simulation algorithm is provided to enable threat simulation. Simulations are generated only if conditions allow, with the objective to prepare the crew for a possible real attack. In case of a simulated threat, a pool of heuristic plannings is again produced, as is customary. The genetic algorithm is applied to this pool of heuristic plannings to enable the generation of increasingly optimized plannings. The suitability criterion constitutes the basis for comparing successively generated best plannings, for instance, for assessing the own ship's chance of survival. This significantly enhances the insight into the functioning of the usually highly complex fire-control system.

When applying the genetic algorithm, the pool of feasible plannings will, in the absence of further provisions, continue to increase, which may adversely affect the system's proper functioning. To this end, a further advantageous embodiment provides a first clearing algorithm for constantly limiting the pool of feasible plannings.

In the event of a given threat, a pool of feasible plannings is heuristically determined on the basis of the suitability criterion and on the basis of a required residual quantity of ammunition. This may entail that the plannings are, in a manner of speaking, designed momentarily, but also that they are at least partly selected from a superpool of feasible plannings, under application of the suitability criterion and in compliance with the required residual quantity of ammunition or other optimization criteria. This offers the advantage that extremely favourable plannings generated by means of the genetic algorithm for example while fighting a simulated threat, can be included in the superpool, directly available for future use.

Since the superpool also continues to grow, a still further advantageous embodiment of the invention is characterized in that there is provided a second clearing algorithm for periodically clearing the superpool of feasible plannings.

BRIEF DESCRIPTION OF THE DRAWING

The invention will now be described in greater detail with reference to FIG. 1, which schematically represents a fire-control system to which the method can be applied.

DETAILED DESCRIPTION OF THE PREFERRED EMBODIMENT

Figure 1:
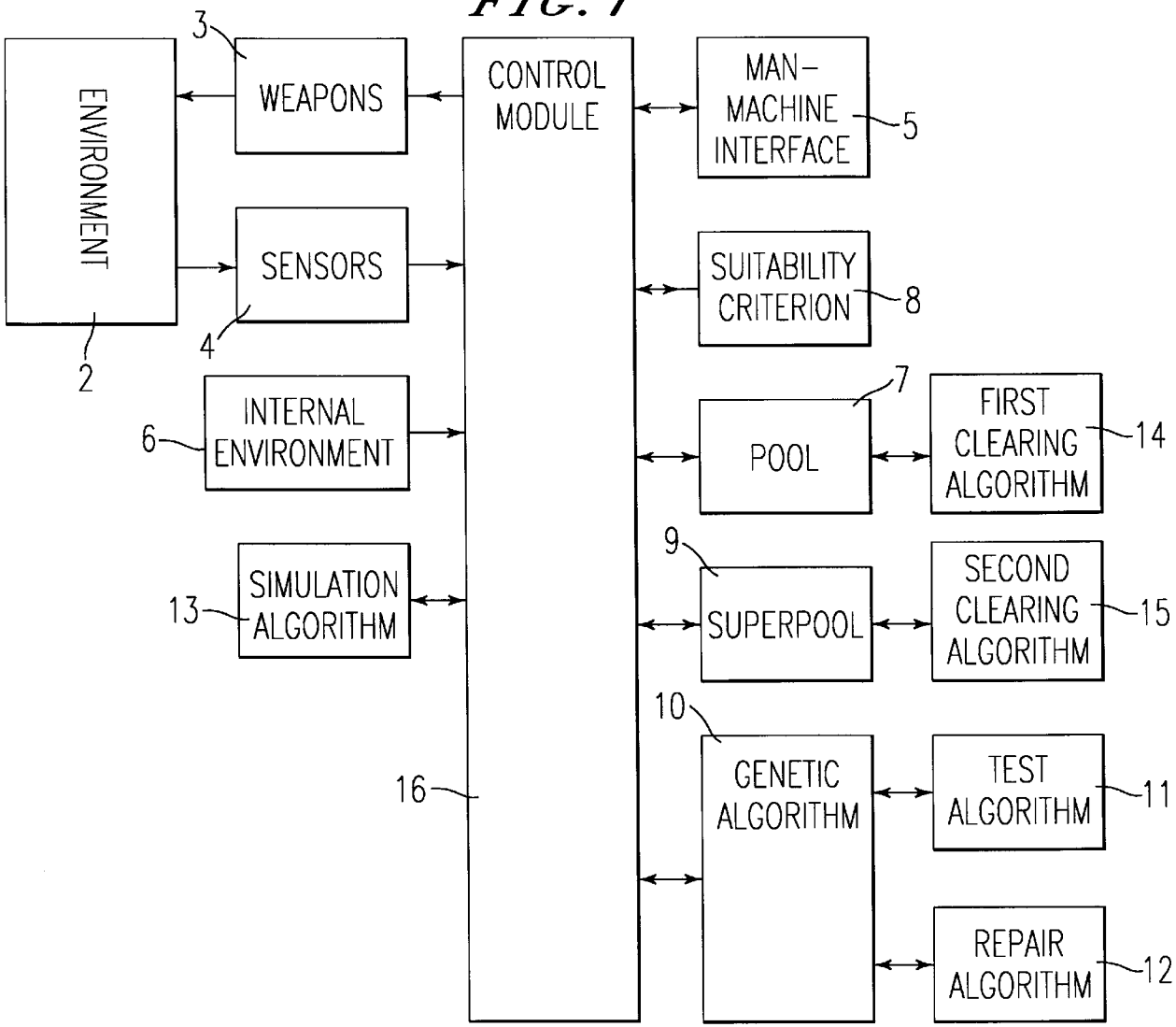

FIG. 1 schematically represents a fire-control system 1, for instance placed on a ship, the primary task of which is to defend the ship or a nearby valuable object against threats emerging from an environment 2. Fire-control system 1 is thereto provided with weapons 3, sensors 4 and a man-machine-interface (MMI) 5, which enables the manual detection of threats, for instance on a radar display and by means of which weapons 3 and sensors 4 can be assigned to engage these threats in accordance with a selected planning. In the event of complex attacks in a multi-threat environment, it may be difficult to select an optimal planning. Besides, the selection depends on many other factors, for instance an internal environment 6, which indicates the weapons 3 and sensors 4 that are still operational, the ammunition available to the various weapons, and the required residual quantity of ammunition per weapon. An other relevant factor is the nature of the ship's mission, for instance survival of the own ship or protection of a nearby valuable object, during war or in peace time. To enable a well-considered decision within the time available, one could automatically determine, on the basis of a number of heuristic rules, a number of feasible plannings to be stored in a pool 7 from which the commander can select in manual mode a planning that seems optimal to him. In this case he may apply a suitability criterion 8 which, taking account of the mission specified via MMI 5, the environment 2, the internal environment 6 and other criteria, such as the required residual quantity of ammunition for countering a possible subsequent attack, can assign a rating to each planning in pool 7. Another possibility is to draw plannings from a superpool 9 of feasible plannings which comprises at least one planning for each conceivable threat. Under application of suitability criterion 8 and the other above-mentioned criteria, pool 7 can be replenished with plannings from superpool 9, each of which has been given a high rating.

A planning from the pool of feasible plannings 7 is composed of actions, each consisting of a point in time, a selected threat, a selected weapon, a selected sensor and a selected firing doctrine, which is the number of rounds fired and the interval between firing the rounds. For each threat at least one feasible planning exists that, under application of the suitability criterion 8, yields an optimal result. In addition, there are feasible plannings that produce a suboptimal result. Finally, there are plannings that, at least for this threat, produce an unsatisfactory result.

Once selected, a planning continues to apply until altered circumstances in environment 2, e.g. the elimination of a target, or in internal environment 6, e.g. a weapon failure or a commander action through MMI 5, necessitate a change of planning.

The object of the invention is to attempt, on the basis of the feasible plannings stored in pool 7, to generate an even more optimal planning. To that end, fire-control system 1 is provided with a genetic algorithm 10, operating on the pool of feasible plannings 7 and continuously creating new generations of plannings. To preclude unfeasible plannings from being stored in pool 7, there is provided a test algorithm 11 that is implemented in such a way that a new generation comprises feasible plannings only. Test algorithm 11 for instance checks if a selected firing doctrine is permissible for a certain weapon, and to this end contains all relevant data concerning the weapons and the sensors.

Of all possible genetic operations on pool 7, the realization of the inventive method described here only deals with the cloning, mutation, permutation and singular crossover operations. In case of cloning, the already available feasible plannings are passed on unmodified to the next generation. Cloning is indispensable to prevent optimal or near-optimal feasible plannings from gradually disappearing. In case of mutation, at least one action in one feasible planning is changed at random, for instance a point in time. With permutation, two actions in one feasible planning are exchanged, for instance the type of weapon. With crossovers, two feasible plannings are each arbitrarily cut in two parts between two successive actions; the resulting parts are subsequently interchanged and pasted together. Mutations, permutations and crossovers are relatively simple operators, for which successive generations may differ significantly from one another. Cloning however is securing a measure of continuity in the succession of generated optimal plannings, which may be of relevance to the user, generally the ship's commander who, with the aid of MMI 5, is capable of at least substantially monitoring the successively generated optimal plannings and who requires these plannings to exhibit a certain measure of continuity and convergence.

In the majority of cases, the outcome of a mutation or crossover will be rejected by test algorithm 11. Therefore a repair algorithm 12 is provided which, using the data regarding weapons and sensors as contained in the test algorithm 11, aims at repairing a local problem. If, for instance, a problem is encountered with a firing doctrine when a gun is fired twice at a too short time interval, the interval between the rounds will be prolonged.

For personnel training and for testing the fire-control system 1, a simulation algorithm 13 is provided to enable threat simulation. On the basis of a simulated threat, a pool 7 is again built up to which genetic algorithm 10 is applied. The use of MMI 5 makes it possible to monitor the successive generations of plannings, to observe how these plannings are evaluated by suitability criterion 8 and to ascertain for instance the ship's chance of survival at each planning.

Because the application of genetic algorithm 10 to pool 7 will only cause an increase in the number of feasible plannings in pool 7, which may adversely affect the reaction time of the fire-control system 1, there is furthermore provided a first clearing algorithm 14 which is aimed at continuously limiting pool 7. For that purpose, Clearing algorithm 14 establishes, for each generation of plannings and with the aid of suitability criterion 8 and possible other criteria, which plannings yield poorest results and subsequently discards these plannings.

Extremely suitable plannings produced by a certain heuristic rule or by the genetic algorithm 10 will be stored in superpool 9 for future use, preferably in a more or less canonical form, without relative insignificant details like the ship's heading and the direction of an attacker. For expanding this canonical form to a planning, the repair algorithm 12 may be used.

Because superpool 9 will continuously expand, there is provided a second clearing algorithm 15 which can periodically be activated. To this end, simulation algorithm 13 successively generates random attacks. For each attack, a group of feasible plannings 7 is selected from superpool 9 with the aid of suitability criterion 8. Within this group of feasible plannings, subgroups of equivalent feasible plannings are located from which, under application of suitability criterion 8 and possible other criteria, only the most suitable feasible planning is retained. In this case, feasible plannings are considered to be equivalent if they differ marginally, for instance a minor shift in time or the selection of similar weapons or sensors. Finally, superpool 9 is changed accordingly.

The realization of the method described here employs a general purpose computer which contains the pool of feasible plannings 7, superpool 9, suitability criterion 8 as well as the various algorithms implemented in software. In addition, a control module 16 is available to allow the information flow between the various software parts in a manner described above.

In automatic mode, control module 16 can automatically detect a threat in a manner known in the art and then generate a pool of feasible plannings 7, select a best feasible planning and activate weapons 3, the above under application of a suitability criterion 8 and possible other criteria as specified beforehand via MMI 5. In the course of this process, fire-control system 1 will, prior to the selection of a best feasible planning, execute genetic algorithm 10 so as to generate an even better feasible planning.

What is claimed is:

1. A method of operating a fire-control system for simultaneously engaging a plurality of threats comprising the steps of:

selecting one plan from a pool of heuristically determined feasible plans based on an environment of the fire-control system and a selected criterion to engage the plurality of threats;

applying a genetic algorithm to the pool of feasible plans prior to selecting the one plan so as to generate additional plans to replenish the pool;

adding at least one randomly selected feasible plan to the pool of feasible plans before applying the genetic algorithm to the pool of feasible plans; and selecting a best feasible plan from the pool with the selected criterion serving as the standard.

2. The method as claimed in claim 1, wherein of the additional plans, only the feasible plans are added to the pool.

3. The method as claimed in claim 2, wherein the genetic algorithm generates successive generations of plans under application of crossovers, mutations, permutations and cloning.

4. The method as claimed in claim 3, wherein the generated crossovers are of the singular type.

5. The method as claimed in claim 3, further comprising the step of:

executing a repair algorithm to convert an unfeasible plan generated by the genetic algorithm into a feasible plan.

6. The method as claimed in claim 1, wherein the best feasible plan is selected at a moment the time available for the selection has at least substantially elapsed.

7. The method as claimed in claim 1, further comprising the step of:

selecting new criterion for the fire-control system based on a type of mission.

8. The method as claimed in claim 1, further comprising the step of:

providing a simulation algorithm to enable a threat simulation.

9. The method as claimed in claim 1, further comprising the step of:

providing a first clearing algorithm for constantly limiting the pool of feasible plans.

10. The method as claimed in claim 1, wherein the pool of feasible plans is at least partly selected from a superpool of feasible plans under application of the selected criterion and in accordance with a required residual quantity of ammunition.

11. The method as claimed in claim 10, further comprising the step of:

providing a second clearing algorithm for periodically clearing the superpool of feasible plans.

* * * * *